US006389775B1

(12) United States Patent
Steiner et al.

(10) Patent No.: US 6,389,775 B1
(45) Date of Patent: May 21, 2002

(54) REINFORCEMENT ELEMENT FOR LOAD-CARRYING OR LOAD-TRANSFERRING STRUCTURAL PARTS AND METHOD FOR FIXING SAID REINFORCEMENT ELEMENT TO THE SURFACE OF A STRUCTURAL PART

(75) Inventors: Werner Steiner; Alexander Bleibler, both of Winterthur (SE)

(73) Assignee: Sika AG, vormals Kasper Winkler & Co. (SE)

( * ) Notice: Subject to any disclaimer, the term of this patent is extended or adjusted under 35 U.S.C. 154(b) by 0 days.

(21) Appl. No.: 09/555,748

(22) PCT Filed: Nov. 13, 1998

(86) PCT No.: PCT/EP98/07276

§ 371 Date: Jul. 14, 2000

§ 102(e) Date: Jul. 14, 2000

(87) PCT Pub. No.: WO99/28575

PCT Pub. Date: Jul. 10, 1999

(30) Foreign Application Priority Data

Dec. 2, 1997 (DE) ..... 197 53 318

(51) Int. Cl.[7] ..... E04C 5/00

(52) U.S. Cl. ..... 52/600; 52/422; 52/309.5; 52/293.2

(58) Field of Search ..... 52/698, 223.1, 52/319, 293.2, 422, 730.2, 600; 410/104, 113, 121

(56) References Cited

U.S. PATENT DOCUMENTS

| | | | | |
|---|---|---|---|---|
| 1,682,726 A | * | 8/1928 | Harloff | |
| 3,284,980 A | * | 11/1966 | Dinkel | 51/600 |
| 4,620,401 A | * | 11/1986 | L'Esperance, et al. | 52/309.15 |
| 4,658,561 A | * | 4/1987 | Russell | 52/662 |
| 5,937,606 A | * | 8/1999 | Meier, et al. | 52/600 |

* cited by examiner

*Primary Examiner*—Carl D. Friedman
*Assistant Examiner*—Basil Katcheves
(74) *Attorney, Agent, or Firm*—Pendorf & Cutliff

(57) ABSTRACT

The invention relates to a reinforcement element (8) for load-carrying or load-transferring structural parts (12). Said reinforcement element has a flat strip segment (100, consisting of a plurality of supporting fibers (26) which are embedded in a binder matrix (28) and are aligned parallel to one another and in the longitudinal direction of the segment. According to the invention, the flat strip segment (10) engages in an anchoring strap (18) with each of its free ends and is secured on said anchoring straps against the tensile and shearing forces exerted in the longitudinal direction of the segment. This enables the flat strip segment (10) can be fixed to a structural part (12) with an impressed pre-stress. The anchoring straps (18) can be anchored on the structural part (12) by means of fixing members (36).

40 Claims, 3 Drawing Sheets

REINFORCEMENT ELEMENT FOR LOAD-CARRYING OR LOAD-TRANSFERRING STRUCTURAL PARTS AND METHOD FOR FIXING SAID REINFORCEMENT ELEMENT TO THE SURFACE OF A STRUCTURAL PART

BACKGROUND OF THE INVENTION

Field of the Invention

The invention concerns a reinforcing element for load-bearing or load-transferring structural components, the reinforcing element comprising a flat strip lamella secured to the surface of a structural component using an adhesive, the flat strip lamella comprising a plurality of reinforcing fibers embedded in a binder matrix and oriented parallel to each other and in the lamella longitudinal direction. The invention further concerns a process for securing this type of reinforcing element to a structural surface.

The reinforcing fibers, which are preferably comprised of carbon fiber, impart to the flat strip lamella a greater elastic extensibility.

SUMMARY OF THE INVENTION

Beginning therewith, it is the task of the present invention to develop a reinforcing element of the above-described type as well as a process for the securing thereof to a structural surface, such that an imprinted tensile stress can be reliably maintained during and after the hardening of the adhesive.

The inventive solution is based on the concept, that the flat strip lamella, on the basis of their large elastic extensibility of the reinforcing fibers, are particularly suitable for pre-tensioning and thus for improvement of the structural support relationship to the reinforced structural component. For this, the flat strip lamellas must be connected at their ends to anchor plates, which make possible the introduction of the pre-tensioning into the structural component, or a tensioning beam provided especially for this, during and after the hardening of the adhesive. In order to accomplish this, it is proposed in accordance with the invention, that each free end of the flat strip lamella respectively engages an anchor plate which via securing means is anchored on the structural unit or on a tensioning beam and thereby is secured against tensile and shear forces acting in the longitudinal direction on the lamella. Advantageously, the anchor plates are materially or chemically connected to the lamella ends, and preferably they are adhered to these. A further improvement of the connection between the anchor plates and the lamella ends can be achieved by force fittingly and/or formed fittingly connecting the anchor plates with the lamella ends, preferably by clamping and/or enclosing between two anchor parts. For production of a form-fitting connection, the lamella ends can respectively be provided with a widening and/or thickening, and the anchor plates with a recess for form-fitting reception of the widening and/or thickening.

In order to make possible a thin layer adhesive application, it is proposed in accordance with a preferred embodiment of the invention that the anchor plates are comprised of an at least a thin-walled floor part and a, in comparison to the floor part, thick-walled cover plate, externally flat and extending over the breadth of the lamella. Preferably, the cover plate is provided with the recess for reception of the widening or thickening of the flat strip lamella. For this purpose the anchor plates can be formed of two parts, wherein the two anchor parts are either adhered together or held together by screws.

A preferred embodiment of the invention envisions that the broadening and/or thickening of the lamella is formed by a divergent splitting of the reinforcing fibers and at the lamella free end, and in certain cases by a widening of the binder matrix in this area. The broadening and/or thickening can, however, also be formed by an application of material, preferably a synthetic resin, on the lamella ends.

In accordance with a further preferred embodiment of the invention it is envisioned that the anchor plates, at least in the area of the entry of the flat strip lamella, are elastic. Thereby, it is made possible that the tensile forces occurring in the transition area are maintained at a reliable level, in that the tensions within the end sections are gradually reduced. In order to achieve this, it is of advantage, when the stiffness at the end sections of the anchor plates at the entry points of the flat strip lamella are gradually reduced. This can be achieved for example in that the wall thickness and/or breadth of the cover part and/or floor part of the anchor plate becomes reduced in the end section towards the entry point of the flat strip lamella. The wall thickness of the floor part of the anchor plate at the entry side corresponds with the layer thickness of the adhesive layer provided on the construction component to be secured.

In accordance with a further advantageous embodiment of the invention it is envisioned that the anchor plates include an anchoring section adjacent the end sections, which is provided with a transverse bore for passage-through of the anchoring screws situated along the sides beyond of the there secured lamella end. During tightening of the securing screws, the lamella end is clamped between the floor part and the cover part of the anchor plate, so that besides the adhesive connection a force-fitting connection results. For improvement of the adhesive connection, it is of advantage when the lamella ends are adhered on both sides, with the cover part and with the floor part of the anchor plate.

A further variant of the invention envisions that the anchor plates include an at least partially flexible tube, preferably with right-angled internal cross-section, and two wedge elements pressed into the tube, and that the respective lamella ends are tensioned between the wedge surfaces of the wedge elements facing each other, and are adhered thereto. In addition, the wedge parts can also be adhered into the tube. A supplemental form-fitting is achieved thereby, that the each other facing wedge surfaces in the lamella longitudinal direction complementary to each other are curved. Therein, it is advantageous, when one of the two wedge elements extends only over a part of the tube length and that the other wedge element on its wedge surface exhibits a preferentially tangential engaging wedge surface which holds the flat strip lamella against the structural side of the tube wall and with this and the flat strip lamella is adhered and/or tensioned. In order to achieve an optimal flexibility of the anchor plates, the tube can be formed as a wrapped tube of glass fiber reinforced plastic. The tube and the wedge elements can be provided with transverse bore holes situated sideways outside of the lamella end for the passage-through of the securing and tensioning screws. In order to increase the flexibility of the anchor plates at the entry side tube end, it is of advantage, when the tube with wedge elements inserted exhibits a reducing wall thickness or breadth at the end section towards the entry side of the tube.

According to a further preferred embodiment of the invention, the flat strip lamellas can be acted upon with an electric current. For this, it is advantageous to construct the anchor plates to be electrically conductive such that they form a contact point for the connection of the carbon fibers to a source of electricity. In this manner, it is possible to accelerate the hardening of the adhesive by resistance heating of the flat strip lamella, and to also increase the thermal stability.

The binder matrix of the flat strip lamella is preferably comprised of a duroplast, preferably an epoxy resin. In principle, the binder matrix can also be a thermoplast, preferably selected from the group consisting of polyolefins, vinyl polymers, polyamide, polyester, polyacetate, polycarbonate, and thermoplastic polyurethane. The reinforcing fibers can, as already described, be carbon fibers. In principle, the reinforcing fibers could also be aramide fibers, glass fibers, or polypropylene fibers.

For maintaining a pre-tension in the flat strip lamella, the lamella ends are first force-, form- and/or materially-(chemically) engaged with the anchor plate. In accordance with a first process possibility, it is proposed that besides this one of the anchor plates is secured to the structural component, for example is screwed in and/or adhered, while the other anchor plate before or after application of adhesive is brought into engagement with a tensioning mechanism associated with the structural component and activated upon by a shear force for achievement of an elastic pre-tension in the flat strip lamella in the lamella longitudinal direction, whereupon the flat strip lamella pre-tensioned in this way is maintained or pressed against the structural component surface until hardening of the adhesive. A second alternative solution envisions that the anchor plates are first fixed to a tension beam with production of an elastic pre-tension in the flat strip lamella, and that the tension beam is pressed or held against the structural component surface with the adhesive side of the flat strip lamella until the adhesive hardens. According to a preferred embodiment of the invention, an electrical current is conducted though at least through a part of the reinforcing fibers during the hardening of the adhesive for heating of the flat strip lamella and the adhesive layer.

For production of the form-fitting engagement between the lamella ends and the anchor plates, the carbon fibers can, at the free ends of the previously cut-to-size flat strip lamellas, be freed of adhesive material, preferably using steam, and split apart forming a broadening and/or thickening, and in this condition, be fixed with a viscous, hardenable binder. The carbon fibers freed of binder matrix are thereby preferably spread apart until divergence at the free lamella ends. The carbon fibers freed of binder matrix are for this purpose preferably introduced into an undercut recess in the anchor plate and there positionally fixed and anchored with a binder which is viscous, hardenable, and at the same time serves as adhesive. The anchor plates are, after achieving a predetermined pre-tension, secured to the structural component or tension beam, preferably by screwing or adhering.

BRIEF DESCRIPTION OF THE DRAWINGS

In the following, the invention will be described in greater detail on the basis of the illustrative embodiments shown in schematic manner in the figures. There is shown.

DETAILED DESCRIPTION OF THE INVENTION

Figure 1:
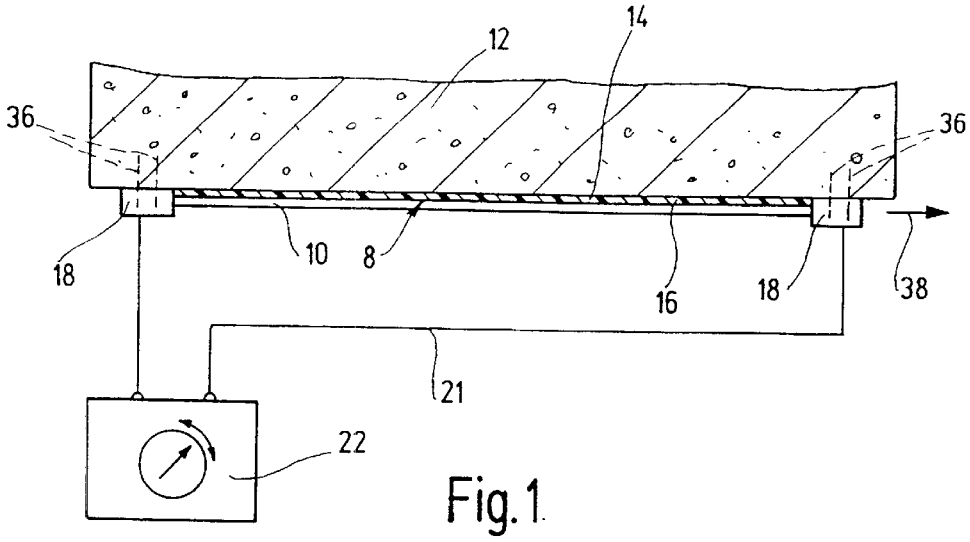
FIG. 1 A section through a structural unit, on which a pre-tensioned reinforcing element in the form of a flat strip lamella is secured with an adhesive while utilizing a heating device.

The reinforcing elements 8 shown in the figures are for the supplemental reinforcing of structural components 12 such as, for example, reinforced concrete, wood, or masonry. They are in the form of a flat strip lamella 10 which with its broad side 14 is secured to the outer surface of the structural component 12 with the aid of an adhesive 16, preferably epoxy resin.

The flat strip lamella 10 is in the form of a composite or interconnect structure comprising a plurality of flexible or limp reinforcing fibers 26 oriented parallel to each other, preferably of carbon fiber, and a binder matrix 28, preferably an epoxy resin, which secures the reinforcing fibers fixed against movement with respect to each other. The binder matrix 28 ensures that the flat strip lamella 10 is stiff elastic.

The reinforcing element 8 is provided on each end of the flat strip lamella 10 with respectively one anchor plate 18. The anchor plate 18 is, in the illustrative embodiments shown in FIG. 2*a* to *c* and 3*a* and *b* comprised of a thin walled floor part 19 and a thick walled cover part 20. The wall thickness of the floor part 19 of the anchor plate 18 is so dimensioned that it corresponds approximately to the adhesive layer thickness of the flat strip lamella 10 in the final assembled condition.

Figure 2A:
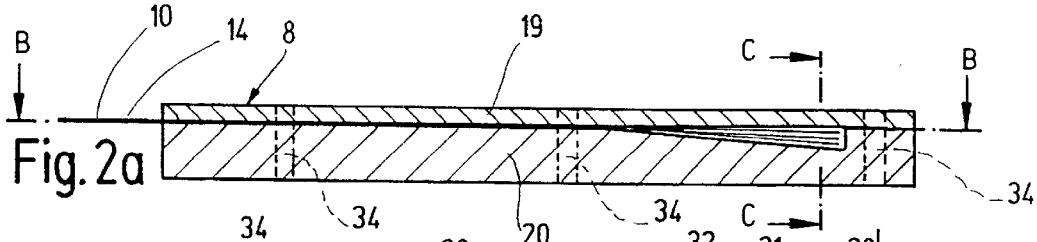
FIG. 2*a* A perpendicular section through a securing element in the area of the anchor plate.
Figure 2B:
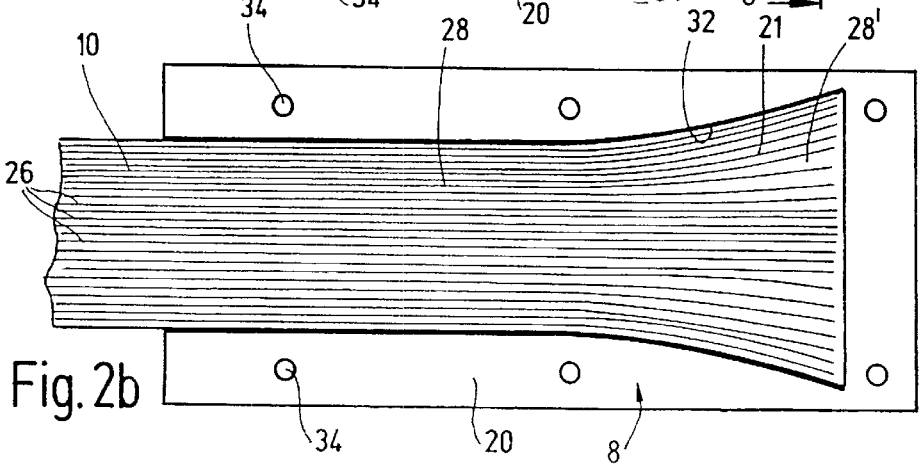
FIG. 2*b* A section along the dividing line B—B of FIG. 2*a;*
Figure 2C:
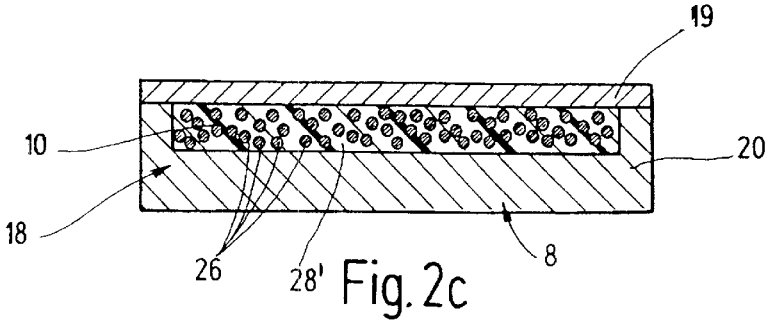
FIG. 2*c* A section along the section line C—C of FIG. 2*a;*

In the embodiment shown in FIG. 2*a* to *c*, the reinforcing fibers 26 at the end of the flat strip lamella 10 are separated, forming a broadening and thickening 21 of the lamella end, which end is then seated or introduced in a corresponding recess 32 in the cover part 20 of the anchor plate 22. The broadening and thickening 21 in the lamella ends can be produced by first removing the binder matrix 28 from the reinforcing fibers 26 using steam and then introducing the reinforcing fibers 26 in the recess 32 of the cover part 20 and fixing thereto with the aid of a binder matrix 28 which simultaneously serves as adhesive. For connecting the floor part 19 and the cover part 20, both parts are provided with aligned screw holes 34, which at the same time are intended for securing the anchor plates to the structural component 12 with the aid of high strength screws 36.

For application of the reinforcing element 8 on the structural component 12, first one of the anchor plates 18 is secured to the structural component 12 by means of screws and then the other anchor plate 18 is brought into engagement by a not shown tensioning mechanism. Then, the anchor plate 18 engaged by the anchor mechanism is pulled in the direction of the arrow 38 and thereby the flat strip lamella 10 is elastically pre-tensioned in a desired amount. The second anchor plate 18 is then, after the pre-tensioning, likewise secured to the structural component 12 and anchored there using high strength screws 36 and adhesives. Then, a flat strip lamella together with the previously applied viscous adhesive 16 is pressed against the construction component outer surface until the adhesive is hardened.

In order to accelerate the hardening of the adhesive 16, the flat strip lamella 10 can be heated with the aid of an electric current. For this purpose, the electrically conductive anchor plates 18 can serve as contact points and, via wiring 21', be connected to a source of current 22 so that an electrical current is conducted through the carbon fibers 26 which contact the anchor plates 18. The carbon fibers 26 form a heat resistor for heating the flat strip lamella 10 and the adhesive 16. For monitoring the temperature, a not shown temperature sensor can be coupled to the flat strip lamella, of which the output signal can be used for controlling or regulating the heat output.

Figure 3B:
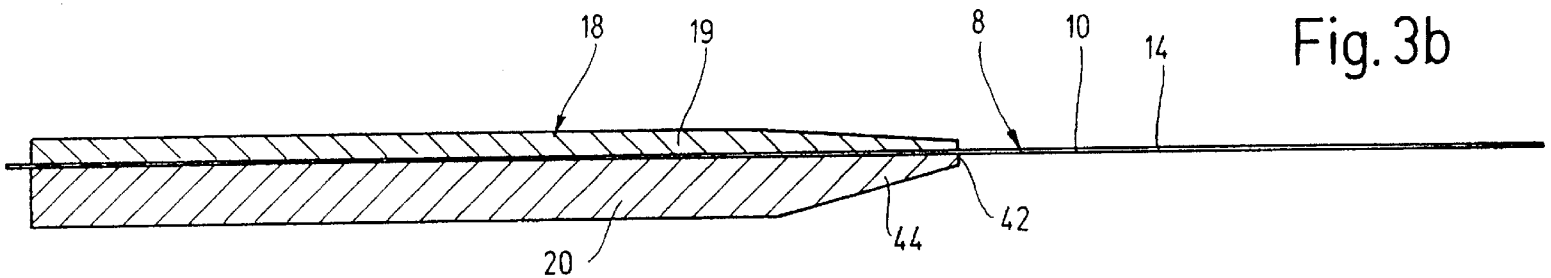
FIG. 3*b* A section along the section line III—III of FIG. 3*a;*
Figure 3A:
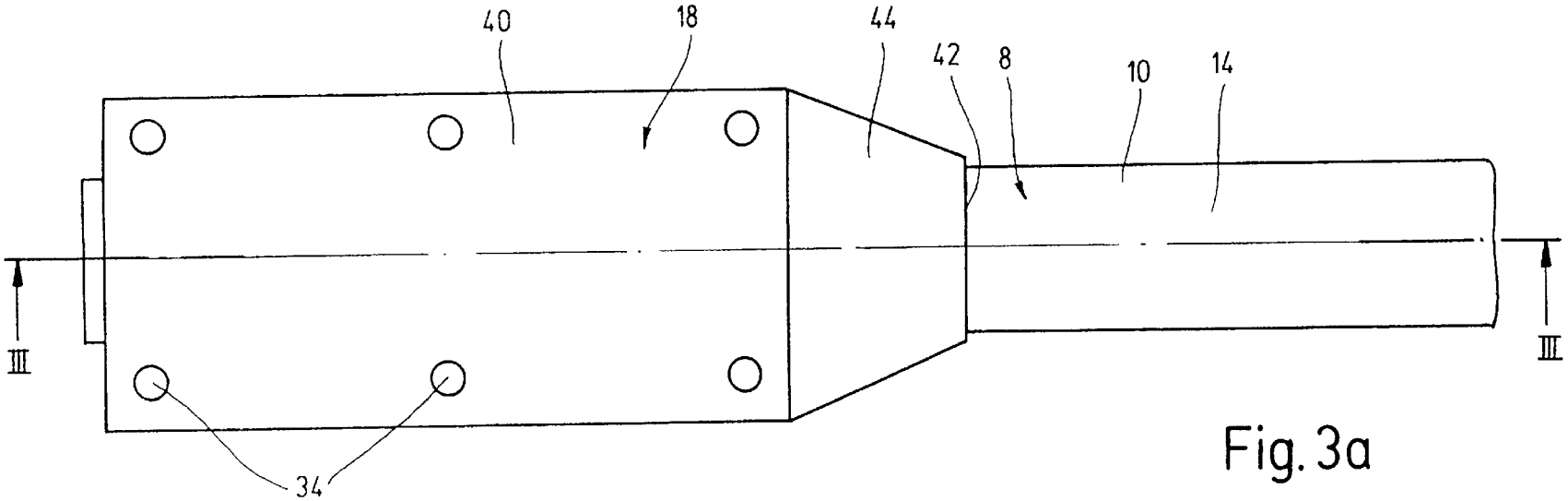
FIG. 3*a* A sectional top view on an alternative reinforcing element in the area of the anchor plate.

In the illustrative embodiment shown in FIG. 3*a* and *b*, the floor part 19 and the cover part 20 are provided with flat or planar tensioning surfaces, which are adhered to each other and to the flat strip lamella 10 lying therebetween. The floor part 19 and the cover part 20 are comprised of a flexible plastic or synthetic material, for example a glass fiber reinforced plastic. The anchor plate is divided into a broader reinforcing section 40 provided with transverse bore-holes 34 for the through-put of securing screws, and an end section 44 which, going towards the entry point 42 of the flat strip lamella 10, narrows both in wall thickness and in breadth. The reduced thickness and breadth of the floor part 19 and the cover part 20 in the area of the end section 44 has as a consequence that the stiffness of the flexible plate is continuously reduced approaching the entry side 42, so that strains or tensions in the lamella, which result from the introduced tensile or pull forces, are gradually diminished in this area. Thereby it is ensured, that no impermissibly high pull forces occur between lamella and anchor, which could lead to a premature leasing of the lamella.

Figure 4B:
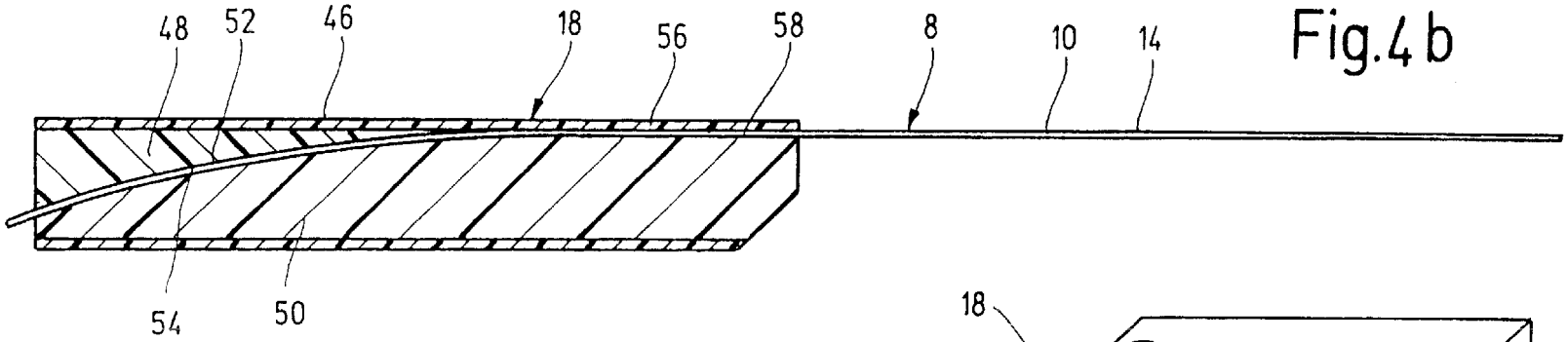
FIG. 4*b* A longitudinal section through the reinforcing element according to FIG. 4*a* in the area of the anchor plate.
Figure 4A:
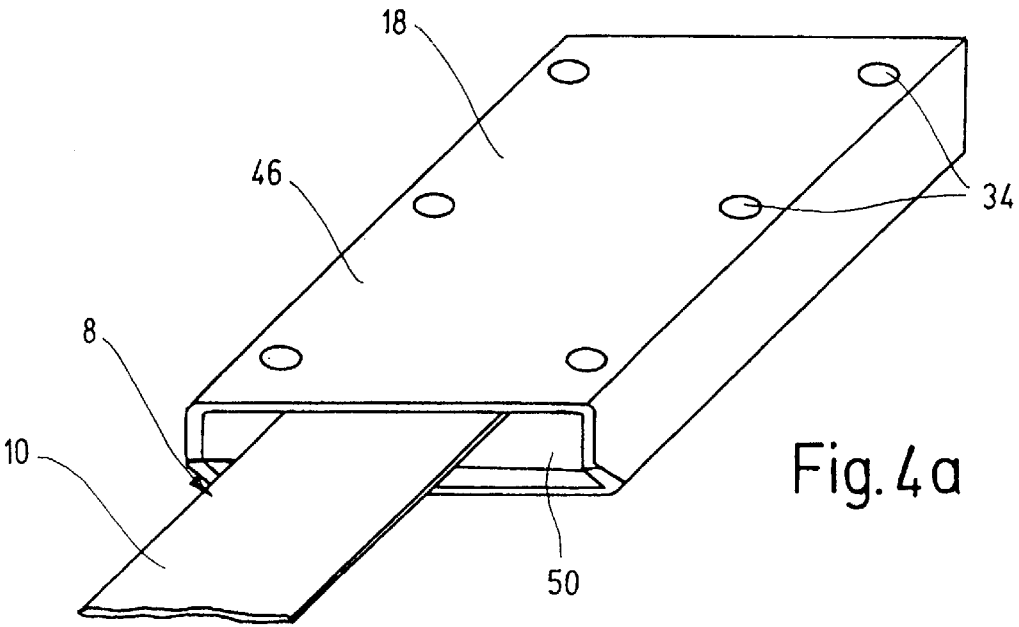
FIG. 4*a* A perspective representation of a reinforcing element in the area of the anchor plate.

In the illustrative embodiment shown in FIG. 4*a* and *b*, the anchor plate 18 is comprised of a wrapped tube 46 of a glass fiber reinforced plastic with right-angled inner cross section as well as two preformed wedge elements 48, 50, which likewise can be formed of glass fiber reinforced plastic. The wedge surfaces 52, 54 of the wedge elements 48, 50 facing each other are so curved complimentary to each other in the lamella longitudinal direction that the flat strip lamella 10 tensioned and adhered between them is guided between the wedge surfaces without wrinkling or kinking. One of the two wedge elements 48 extends only over a part of the wrap tube 46, while the other wedge element 50 exhibits a planar or flat partial surface 58 holding the flat strip lamella against the construction component side of the tube wall 56 such that it is adhered and tensioned thereto. Thanks to the substantially free selectability of the arrangement of the fibers in the wrap tube 46 and the incline or taper provided on the entry side end 42 it is also possible to here adjust the distribution of stiffness of the anchor plate. The curvature of the flat strip lamella 10 which becomes greater going from the entry side 42 towards the end furthest removed from the load, and the adhering and wedging between the lamella and the wrap tube, results in a reliable, form-fitting anchoring of the anchor plate to the flat strip lamella. The wedge elements 48, 50 are supplementally fixed in their position with respect to the wrap tube 46 via the through-going securing bore holes 34.

In summary, the following is to be concluded: The invention concerns a reinforcing element 8 for load-bearing or load-transmitting structural components 12. The reinforcing element includes a flat strip lamella 10, which is comprised of a plurality of reinforcing fibers 26 which are which are embedded in a binder matrix 28 and run parallel to each other in the lamella longitudinal direction. In order to be able to secure the flat strip lamella 10 to the structural component 12 with an imprinted pre-tension, the lamella engages with both of its free ends in respectively one anchor plate 18 anchorable to the construction component 12 by means of securing means 36, and the lamella is secured in the anchor plate against tensile and sheer forces occurring in the lamella longitudinal direction.

What is claimed is:

1. Reinforcing element for load-bearing or load-transmitting structural components (12), comprising a flat strip lamella secured to a structural component outer surface by means of an adhesive layer (16), which flat strip lamella is comprised of a plurality of parallel to each other and parallel to the lamella longitudinal direction oriented reinforcing fibers (26) embedded in a binder matrix (28), wherein the respective free ends of the flat strip lamella (10) are in engagement with respectively one anchor plate (18) which is anchorable to a construction component (12) or a tension beam by means of securing means (36), which anchor plate protects the lamella against tensile and sheer forces acting upon the lamella in the longitudinal direction, the anchor plates (18) are elastically bendable and ductile at least in the entry area (42, 44) of the flat strip lamella (10), and the stiffness in the end section (44) of the anchor plate (18) steadily decreases going towards the entry side (42) of the flat strip lamella.

2. Reinforcing element according to claim 1, wherein the anchor plates (18) are materially engagingly connected with the flat strip lamella ends, preferably by adhesion.

3. Reinforcing element according to claim 1, wherein the anchor plates are engaged with the lamella free ends under force, preferably clamped between two anchor parts (19, 20).

4. Reinforcing element according to claim 1, wherein the anchor plates (18) are form-fittingly connected with the lamella ends.

5. Reinforcing element according to claim 4, wherein the lamella ends respectively exhibit a widening and/or thickening (21) and the anchor plates (18) are provided with a recess (32) for form-fitting reception of the widening and/or thickening (21).

6. Reinforcing element according to claim 1, wherein the anchor plates (18) are comprised of a thin-walled, externally flat floor part (19) and a, compared to the floor part, thick-walled cover part (20).

7. Anchoring element according to claim 6, wherein the anchor plate extends at least over the breadth of the lamella.

8. Anchoring element according to claim 5, wherein the widening and/or thickening (21) is formed by a divergent splitting apart of the reinforcing fibers (26) at the free lamella end.

9. Flat strip lamella according to claim 1, wherein the widening and/or thickening (21) is formed by a widening of the binder matrix (28').

10. Reinforcing element according to claim 1, wherein the widening and/or thickening (21) is formed by a material overlay or application preferably of synthetic resin.

11. Flat strip lamella according to claim 1, wherein the anchor plate (18) is formed of two parts.

12. Flat strip lamella according to claim 1, wherein the anchor plates (18) are provided with transverse bore holes (34) for the passage of high-strength securing screws (36).

13. Reinforcing element according to claim 6, wherein the wall thickness and/or the breadth of the cover part (20) and/or the floor part (19) in the end section (44) of the anchor plate (18) towards the entry side (42) of the flat strip lamella declines.

14. Anchoring element according to claim 1, wherein the anchor plates (18) are provided with an anchoring segment (40) adjacent to the end segment (44), which is provided with transverse bore holes (34), sideways beside the secured lamella ends, for passage through of the anchoring screws (36).

15. Anchoring element according to claim 6, wherein the wall thickness of the floor part (19) of the anchoring plate (18) at the entry point (42) corresponds to the layer thickness of the adjoining adhesive layer (16).

16. Anchoring element according to claim 6, wherein the lamella ends are adhered to both the cover part (20) as well as the floor part (19) of the anchor plates (18).

17. Anchoring element according to claim 1, wherein the anchor plates (18) comprise a tube (46) with at least partially flexible, preferably with right-angle internal cross section, and lever elements (48, 50) pressed into the tube (46), and that the respective lamella ends are tensioned between the facing wedge surfaces (52, 54) of the wedge elements (48, 50) and are adhered to these.

18. A reinforcing element for load-bearing or load-transmitting structural components (12) comprising a flat strip lamella secured to a structural component outer surface by means of an adhesive layer (16), wherein the flat strip lamella is comprised of a plurality of parallel to each other and parallel to the lamella longitudinal direction oriented reinforcing fibers (26) embedded in a binder matrix (28), wherein the flat strip lamella further comprises anchor plates (18) having a tube (46) with at least partially flexible, preferably with right-angle internal cross section, and lever elements (48, 50) pressed into the tube (46), and that the respective lamella ends are tensioned between the facing wedge surfaces (52, 54) of the wedge elements (48, 50) and are adhered to these.

19. Anchoring element according to claim 17, wherein the wedge elements (48, 50) are adhered in the tube (46).

20. Anchoring element according to claim 17, wherein the facing wedge surfaces (52, 54) are curved complimentary to each other in the lamella longitudinal direction.

21. Anchoring element according to claim 17, wherein one of the two wedge elements (48) extends only over a part of the tube length and that the other wedge element (50) exhibits a partial surface preferably adjoining tangentially to its wedge surface (54), which holds the flat strip lamella against a structural-component-facing side of the tube wall (56) and such that the flat strip lamella is adhered and/or tensioned with the tube wall and the wedge partial surface.

22. Anchoring element according to claim 17, wherein the tube (46) is a wrapped or wound tube of glass fiber reinforced plastic.

23. Anchoring element according to claim 17, wherein the wedge elements (48, 50) are comprised of glass fiber reinforced plastic.

24. Anchoring element according to claim 17, wherein the tube (46) and the wedge elements (48, 50) are provided with transverse boreholes (34) for the passage through of securing screws (36) along their sides beside the lamella ends.

25. Anchoring element according to claim 17, wherein the tube fitted with the wedge elements (48, 50) have an end section (44) reducing in thickness and/or breadth towards the lamella entry side.

26. Anchoring element according to claim 1, wherein the flat strip lamella is heatable by an electric current.

27. Anchoring element according to claim 26, wherein the anchor plates (18) are electrically conductive and form a contact for connection of the reinforcing fibers, which preferably are comprised of carbon fiber (20), to the electrical current source (22).

28. Anchoring element according to claim 1, wherein at least one of the anchor plates (18) exhibits a shoulder serving as abutment for a tensioning device engaging in the lamella longitudinal direction.

29. A reinforcing element for load-bearing or load-transmitting structural components (12) with a flat strip lamella secured to a structural component outer surface by means of an adhesive layer (16), wherein the flat strip lamella is comprised of a plurality of parallel to each other and parallel to the lamella longitudinal direction oriented reinforcing fibers (26) embedded in a binder matrix (28), wherein at least one of anchor plates (18) exhibits a shoulder as abutment for a tensioning device engaging in the lamella longitudinal direction.

30. Anchoring element according to claim 1, wherein the binder matrix is comprised of a duroplast, preferably of epoxy resin.

31. Anchoring element according to claim 1, wherein the binder matrix is comprised of a thermoplast, preferably selected from the group consisting of polyolefin, vinyl polymer, polyamide, polyester, polyacetate, polycarbonate, and thermoplastic polyurethane.

32. Anchoring element according to claim 1, wherein the reinforcing fibers (26) are comprised of carbon fibers, aramid fibers, glass fibers, and/or polypropylene fibers.

33. Process for securing a flat strip lamella (10) to the outer surface of a structural component (12), the flat strip lamella comprised of a plurality of reinforcing fibers (26) embedded in a binder matrix (28), parallel to each other and extending in the lamella longitudinal direction, wherein a broad side of the flat strip lamella (10) is pressed against the structural component surface via an adhesive layer (16) applied in a viscous consistency, preferably a reaction or curing resin, and the adhesive layer is hardened with formation of an adhesive bonding, wherein the lamella ends are forced, formed, and/or materially connected with an anchor plate (18), that one of the anchor plates (18) is secured to a structural component and the other anchor plate (18) prior to or after application of the adhesive is engaged with a tensioning mechanism secured to the structural component, and that the flat strip lamella (10) is acted upon with a pull force directed in the lamella longitudinal direction (38) with production of an elastic deformation, and that the flat strip lamella pre-tensioned in this manner is held or pressed against the structural component surface until hardening of the adhesive.

34. Process for securing to the outer surface of a structural component (12) a flat strip lamella (10) comprised of a plurality of reinforcing fibers (26) embedded in a binder matrix (28), parallel to each other and extending in the lamella longitudinal direction, wherein a broad side of the flat strip lamella (10) is pressed against the surface of the structural component via an intermediate adhesive layer (16) applied in a viscous consistency, preferably a reaction or curing resin, and wherein the adhesive layer is hardened with formation of an adhesive bonding, wherein the lamella ends are force-, form-, and/or materially-connected with an anchor plate (18), that the anchor plates (18) are first secured to a tension beam with production of an elastic pre-tension in the flat strip lamella (10), that the tension beam is pressed or held with the adhesive side of the flat strip lamella (10)

against the structural component outer surface until the adhesive is hardened, and that subsequently the tension beam is removed from the flat strip lamella.

35. A process according to claim 33, wherein an electrical current is conducted through at least a part of the reinforcing fibers (26) for heating the flat strip lamella (10).

36. Process according to claim 33, wherein the lamella ends are widened and/or thickened (21) prior to connecting with the anchor plates (18).

37. A process according to claim 36, wherein the reinforcing fibers (26) at the ends of the previously cut to size flat strip lamellas (10) are freed of the binder matrix (28), preferably using steam, and with the formation of a widening and/or thickening (21) are spread apart and in this condition are fixed with viscous, hardenable binder (28').

38. A process according to claim 37, wherein the reinforcing fibers (26) freed of the binder matrix are split apart divergently towards the free lamella ends.

39. A process according to claim 36, wherein the reinforcing fibers (26) freed of binder matrix are introduced into a cut-back recess (32) of the anchor plate (18) and there are positionally fixed and anchored with a binder (28) that is viscous, hardenable, at the same time serves as adhesive.

40. Process according to claim 33, wherein the second anchor plate (18) after achieving a predetermined pretension (arrow 38) is secured, preferably by screwing, onto the structural component (12) or the tensioning beam.

* * * * *